US007882700B2

(12) United States Patent
Yamakura et al.

(10) Patent No.: US 7,882,700 B2
(45) Date of Patent: Feb. 8, 2011

(54) EXHAUST PIPE STRUCTURE

(75) Inventors: Yutaka Yamakura, Saitama (JP); Hideo Amino, Saitama (JP); Takero Shibukawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 880 days.

(21) Appl. No.: 11/806,052

(22) Filed: May 29, 2007

(65) Prior Publication Data

US 2007/0277517 A1 Dec. 6, 2007

(30) Foreign Application Priority Data

May 31, 2006 (JP) ..... 2006-151206

(51) Int. Cl.
*F01N 1/00* (2006.01)

(52) U.S. Cl. ..... 60/323; 60/272; 60/312; 60/313; 60/322; 180/89.2; 180/296; 180/309

(58) Field of Classification Search ..... 60/272, 60/274, 312, 313, 314, 322, 323, 324; 180/89.2, 180/296, 309
See application file for complete search history.

(56) References Cited

U.S. PATENT DOCUMENTS 4,301,651 A * 11/1981 Cocchiara et al. ..... 60/282
4,359,865 A * 11/1982 Nakao et al. ..... 60/313
RE31,989 E 9/1985 Nomura et al.
4,860,538 A * 8/1989 Takeuchi ..... 60/313
5,293,744 A * 3/1994 Imagawa et al. ..... 60/302
6,334,501 B1 * 1/2002 Kawamoto ..... 180/309
6,688,929 B2 * 2/2004 Lecours et al. ..... 440/89 R

FOREIGN PATENT DOCUMENTS

EP 1 710 411 A1 10/2006
JP 59-99020 A 6/1984
JP 60-18839 U 2/1985
JP 2003-48591 A 2/2003

* cited by examiner

*Primary Examiner*—Binh Q Tran
(74) *Attorney, Agent, or Firm*—Birch, Stewart, Kolasch & Birch, LLP

(57) ABSTRACT

To provide an exhaust pipe structure in which the length of the exhaust pipe can be elongated while the total dimension is restricted. Provided is an exhaust pipe structure which includes an upstream-side exhaust pipe connected to exhaust ports of an engine. An exhaust chamber is provided which has an exhaust-gas inlet and an exhaust-gas outlet, and in which the upstream-side exhaust pipe is connected to the exhaust-gas inlet. In addition, the exhaust pipe structure includes a downstream-side exhaust pipe which is connected to the exhaust-gas outlet and which extends in such a direction as to move away from the exhaust ports. In the exhaust pipe structure, the exhaust-gas inlet is formed at a position farther away from the exhaust ports than the exhaust-gas outlet is positioned.

20 Claims, 6 Drawing Sheets

EXHAUST PIPE STRUCTURE

CROSS-REFERENCE TO RELATED APPLICATIONS

The present application claims priority under 35 USC 119 to Japanese Patent Application No. 2006-151206 filed on May 31, 2006 the entire contents of which are hereby incorporated by reference.

BACKGROUND OF THE INVENTION

1. Field of the Invention

The present invention relates to an exhaust pipe structure for vehicles such as motorcycles.

2. Description of Background Art

An exhaust pipe structure is known wherein an exhaust chamber is provided somewhere along the exhaust pipe extending in the front-to-rear direction of vehicle, with an exhaust-gas inlet formed at the front side of the exhaust chamber and an exhaust-gas outlet formed at the rear side. See, for example, Japanese Utility Model Application Laid-Open No. Sho 60-18839.

In the above-mentioned exhaust pipe structure, for the purpose of making a change in engine characteristics (particularly, engine power) depends linearly on the throttle opening angle. Possible ways of achieving this object include elongating the exhaust pipe, and increasing the volume of the exhaust chamber. These measures, however, accompany an increase in the length of the exhaust pipe as a whole in the front-to-rear direction, and an enlargement of the dimension of the exhaust chamber, so that it is sometimes difficult to secure a space for placing the elongated exhaust pipe or the enlarged exhaust chamber.

SUMMARY AND OBJECTS OF THE INVENTION

An embodiment of the present invention provides an exhaust pipe structure in which the exhaust pipe can be elongated while the increase in the overall dimension is restricted.

For the purpose of solving the above-mentioned problems, a first embodiment of the present invention provides an exhaust pipe structure that includes an engine 25 supported by a body frame 5. The exhaust pipe structure also includes an upstream-side exhaust pipe 36 connected to exhaust ports 27*b* and 28*b*. In addition, the exhaust pipe structure includes an exhaust chamber 35 that has an exhaust-gas outlet 52 and an exhaust-gas inlet 51 to which the upstream-side exhaust pipe is connected. Moreover, the exhaust pipe structure includes a downstream-side exhaust pipe 37 that is connected to the exhaust-gas outlet and extends in such a direction to move away from the exhaust port. In the exhaust pipe structure with the above configuration, the exhaust-gas inlet is formed in a position farther away from the exhaust port relative to the location of the exhaust-gas outlet.

A second embodiment of the present invention provides an exhaust pipe structure wherein the body frame includes a head pipe 6 and a right and left pair of down frames 9 extending from the head pipe obliquely downwardly and rearwardly. In addition, lower frames 13 are provided with each extending rearwardly from the bottom end of each down frame. Moreover, lower end frames 14 are provided with each extending obliquely upwardly and rearwardly from the rear end of each lower frame. Furthermore, the exhaust chamber is placed at the rear of the lower end frame when viewed from a side of the vehicle.

A third embodiment of the present invention provides an exhaust pipe structure wherein the exhaust port and the exhaust-gas inlet are placed in positions at the inner side in the lateral direction of the body frame. In addition, the middle section of the upstream-side exhaust pipe is placed in a position at the outer side in the lateral direction of the body frame.

A fourth embodiment of the present invention provides an exhaust pipe structure wherein the upstream-side exhaust pipe includes an inward diagonal section 56 in which the pipe goes inward of the vehicle body as the pipe goes down the stream of the exhaust gas. Meanwhile, the downstream-side exhaust pipe includes an outward diagonal section 57 in which the pipe goes outward of the vehicle body as the pipe goes down the stream of the exhaust gas. The inward diagonal section and the outward diagonal section cross each other, when viewed from the bottom of the vehicle body, in a position below the rider's seat, for example, a front seat 41*a*, is supported by the body frame.

According to an embodiment of the present invention, the adjustment range for the engine characteristics can be made wider in comparison to the case in which the exhaust-gas inlet is placed closer to the exhaust port than the exhaust-gas is placed. This is made possible because both of the upstream-side exhaust pipe and the downstream-side exhaust pipe can be elongated while the length of the exhaust pipe structure as a whole in the front-to-rear direction is restricted.

According to an embodiment of the present invention, an adequate volume of the exhaust chamber can be secured because the space behind the lower end frame that extends obliquely upwardly and rearwardly can be used efficiently as a space for placement of the exhaust chamber.

According to an embodiment of the present invention, the adjustment range for engine characteristics can be made wider by elongating the upstream-side exhaust pipe, because the upstream-side exhaust pipe can be curved as being convex outwards of the vehicle body.

In an embodiment of the present invention, the inward diagonal section and the outward diagonal section project outwardly of the vehicle body in only a restricted amount in the crossing part of these sections when viewed from the bottom of the vehicle body. As a result, the rider can plant his/her foot more easily on the ground because the space on which the passenger can put his/her foot becomes wider below the rider's seat.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
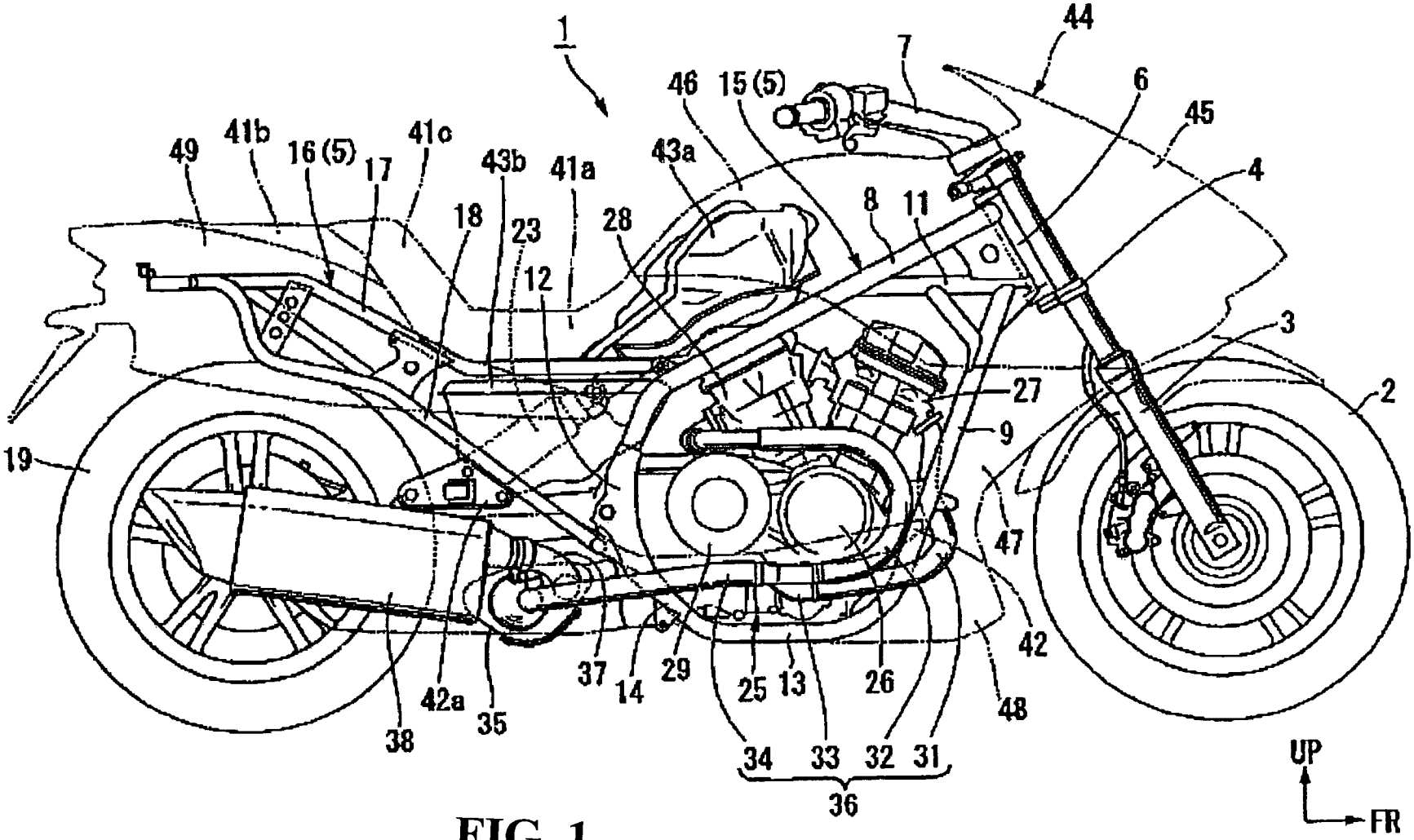
FIG. 1 is a right-side view of a motorcycle according to an embodiment of the present invention.

Hereinbelow, descriptions will be given as to an embodiment of the present invention with reference to the drawings. In the descriptions below, directions with respect to front, rear, right, left and the like are the same as those in the vehicle unless otherwise indicated. In the drawings, an arrow FR points to the front of the vehicle, an arrow LH points to the left-handed direction of the vehicle, and an arrow UP points to the upward direction of the vehicle.

As shown in FIG. 1, a front wheel 2 of a saddle-ride type motorcycle 1 is rotatably supported by a right and left pair of bottom end portions of a front fork 3. The upper portion of each front fork 3 is pivotally and steerably supported by a head pipe 6 at the front-end portion of a body frame 5, with a steering stem 4. A handlebar 7 for steering the front wheel is attached to the upper portion of the steering stem 4. A right and left pair of main frames 8 extend obliquely downwardly and rearwardly from the upper portion of the head pipe 6. A right and left pair of gusset pipes 11, which are substantially horizontal when viewed from a side, are provided to bridge the lower portion of the head pipe 6 and respective middle portions of the right and the left main frames 8. From portions of the respective right and the left gusset pipes near the lower portion of the head pipe 6, from the front-end portions of the respective right and the left gusset pipes 11, a right and left pair of down frames 9 extends obliquely downwardly and rearwardly, with a steeper angle than the main frames 8.

The rear end portions of the respective right and the left main frames 8 bend obliquely downwardly and rearwardly. The bottom end portions of the right and the left main frames 8 are connected respectively to the upper end portions of a right and left pair of pivot frames 12, which are located in the center portion of the vehicle body in the front-to-rear direction. The lower portions of the right and the left down frames 9 bend rearwardly in an underside of the front portion of the vehicle body, and then extend rearwardly substantially in a horizontal direction to form a right and left pair of lower frames 13. The rear portions of the right and the left lower frames 13 bend obliquely upwardly and rearwardly in an underside of the center portion in the front-to-rear direction of the vehicle body. Then, the rear portions of the right and the left lower frames 13 extend upwardly and rearwardly toward the bottom end portions of the corresponding right and the left pivot frames 12 to form a right and left pair of lower end frames 14. The upper end portions of the right and the left lower end frames 14 are connected to the bottom end portions of the right and the left pivot frames 12. As a result, a double-cradle type main frame portion 15 of the body frame 5 is formed.

At the rear of the main frame portion 15, a seat frame portion 16 is formed to support the rider's seat and the like. The seat frame portion 16 includes a right and left pair of seat rails 17, which extends rearwardly, respectively, from the rear portions of the right and the left main frames 8. Also included is a right and left pair of seat stays 18, which extend upwardly and rearwardly, respectively, from the rear portions of the right and the left pivot frames 12. Each of the right and the left seat rails 17 is formed in a shape of a crank with the rear portion bending upwardly when viewed from a side. The right and the left seat stays 18 support respectively the right and the left seat rails 17, with the rear end portion of each seat stay 18 being connected to the rear end portion of a corresponding one of the seat rails 17. It should be noted that the rear portions of the right and the left seat stays 18 are formed asymmetrically to each other.

A swing arm 20 is provided to support a rear wheel 19, while the front-end portion of the swing arm 20 is pivotally supported, as being capable of swinging up and down, by the right and the left pivot frames 12. An arm portion 20*a*, offsetted to the left, extends rearwardly and slightly downwardly, from the front-end portion (base-end portion) of the swing arm 20. At the rear end portion (tip-end portion) of the arm portion 20*a*, which is a cantilever-type swing arm, the rear wheel 19 is rotatably supported. The arm portion 20*a* is made to be a hollow member, and an unillustrated drive shaft is inserted into the inside of the arm portion 20*a*. The rear end portion of the arm portion 20*a* is configured to be a final gear case 21, where the rear end portion of the drive shaft and the rear wheel 19 are engaged with each other to allow the transmission of the drive power. A rear shock absorber 23, which slants rearwardly and downwardly, is placed between a middle portion of the arm portion 20*a* in the front-to-rear direction of the vehicle and a cushion support portion 22 on the left side at the rear portion of the body frame 5.

An engine 25 is mounted inside the main frame portion 15 of the body frame 5, with the crankshaft arranged along the vehicle-width (lateral) direction. The engine 25 is a two-cylinder engine of the narrow-angled V-type. A forward-leaning cylinder 27 and a rearward-leaning cylinder 28 are installed upright over a crankcase 26. A transmission case 29 is continuingly formed at the rear portion of the crankcase 26. At the output portion located on the left side of the transmission case 29, the front-end portion of the drive shaft and the engine 25 are engaged with each other as being capable of transmitting the drive power.

Intake ports 27*a* and 28*a* are respectively formed in a rear portion of the forward-leaning cylinder 27 and in a front portion of the rearward-leaning cylinder 28. An unillustrated throttle body is connected to each of the intake ports 27*a* and 28*a*. On the other hand, exhaust ports 27*b* and 28*b* are respectively formed in a front portion of the forward-leaning cylinder 27 and in a rear portion of the rearward-leaning cylinder 28. Base-end portions of a first and a second exhaust pipes 31 and 32 are respectively connected to the exhaust ports 27*b* and 28*b*. The forward-leaning- and the rearward-leaning cylinders 27 and 28 of the engine 25, as well as the intake- and the exhaust ports 27*a*, 28*a*, 27*b* and 28*b* of these cylinders are positioned inside the body frame 5 in the lateral direction.

The exhaust pipes 31 and 32, as winding appropriately, are brought below the crankcase to the right side thereof. The exhaust pipes 31 and 32 are joined together in a joint portion 33 to form a joint exhaust pipe 34. The joint exhaust pipe 34 is connected to an exhaust chamber 35, which is placed below the arm portion 20*a*, and between the lower end frames 14 and the rear wheel 19 when viewed from a side. Hereafter, the part that the first and the second exhaust pipes 31 and 32, the joint portion 33, the joint exhaust pipe 34 constitute is referred to as an upstream-side exhaust pipe 36.

A downstream-side exhaust pipe 37 leads out of the exhaust chamber, and is connected to a muffler 38 placed at the right side of the rear wheel 19. The exhaust chamber 35 is equipped with a catalyst 54*d* for exhaust-gas purification, and serves as a silencer. Use of two silencers, that is, the exhaust chamber 35 and the muffler 38, improves the sound deadening performance, while the adjustment range of the tone of the exhaust noise can be widened.

The seat frame portion 16 supports, in the front part thereof, the front seat 41*a* for the rider, and supports, in the rear part thereof, a pillion seat 41*b* for the pillion passenger. The seat height of the front seat 41*a* is relatively low, and the step portion between the front seat 41*a* and the pillion seat 41*b* is a backrest 41*c*. A step board 42 for the rider is provided on each side of the vehicle body in the front part across the crankcase 26 and the down frame 9 when viewed from a side. A pillion step holder 42*a* is attached to the middle portion, in the front-to-rear direction, of each of the right and left seat stays 18 to support a step for the pillion passenger. An upper-stage fuel tank 43*a* is placed in front of the front seat 41*a*, while a lower-stage fuel tank 43*b* is placed under the front seat 41*a*.

A body cover 44, made of resin, appropriately covers the vehicle body of the motorcycle 1. The body cover 44 is mainly composed of a front cowl 45, a tank cover 46, a front side cover 47, an under cover 48, and a rear side cover 49. The front cowl 45 covers the area extending from the portion in front of the head pipe 6 to both sides of the head pipe 6. The tank cover 46 is formed continuingly from the rear of the front cowl 45, and covers the upper-stage fuel tank 43*a* and the like. The front side cover 47 extends downwardly from the two sides of the lower portion of the front cowl 45, and covers the down frames 9 and the like. The under cover 48 covers the portion that includes the two sides of the lower portion of the engine 25. The rear side cover 49 covers the two sides of the rear portion of the seat frame portion 16.

Figure 2:
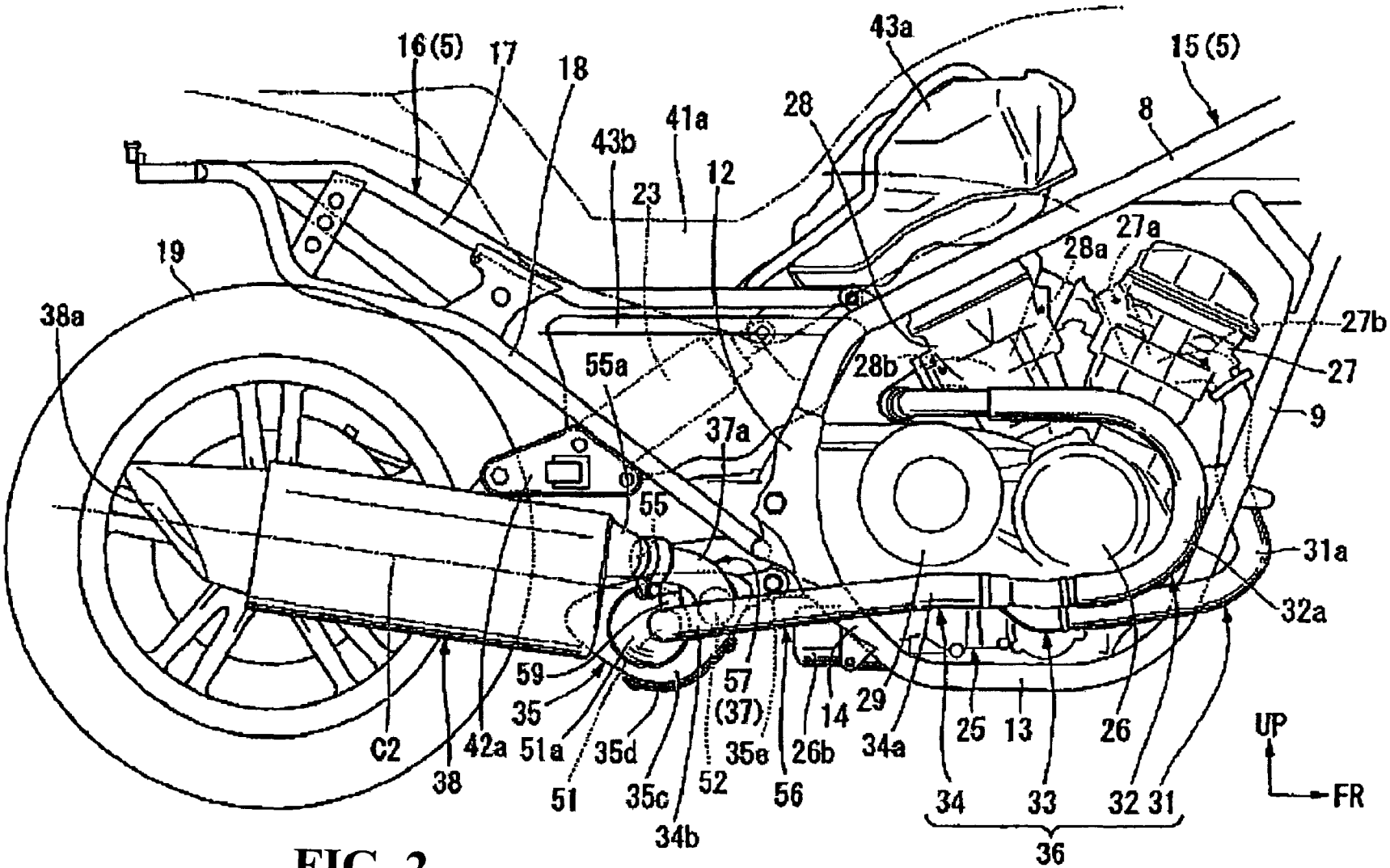
FIG. 2 is a right-side view of the area around an exhaust pipe of the motorcycle.
Figure 4:
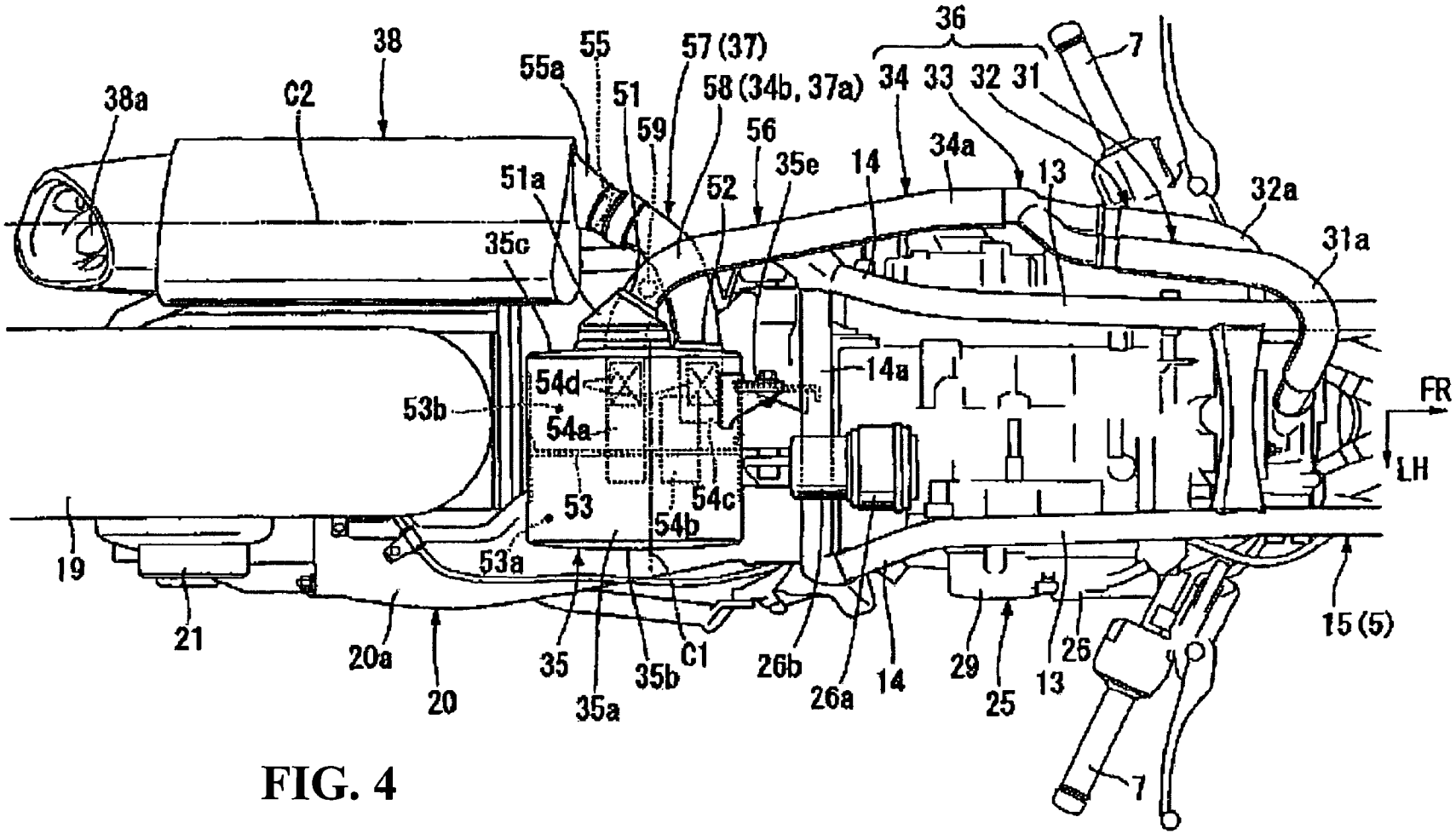
FIG. 4 is a bottom view of the area around the exhaust pipe of the motorcycle.
Figure 5:
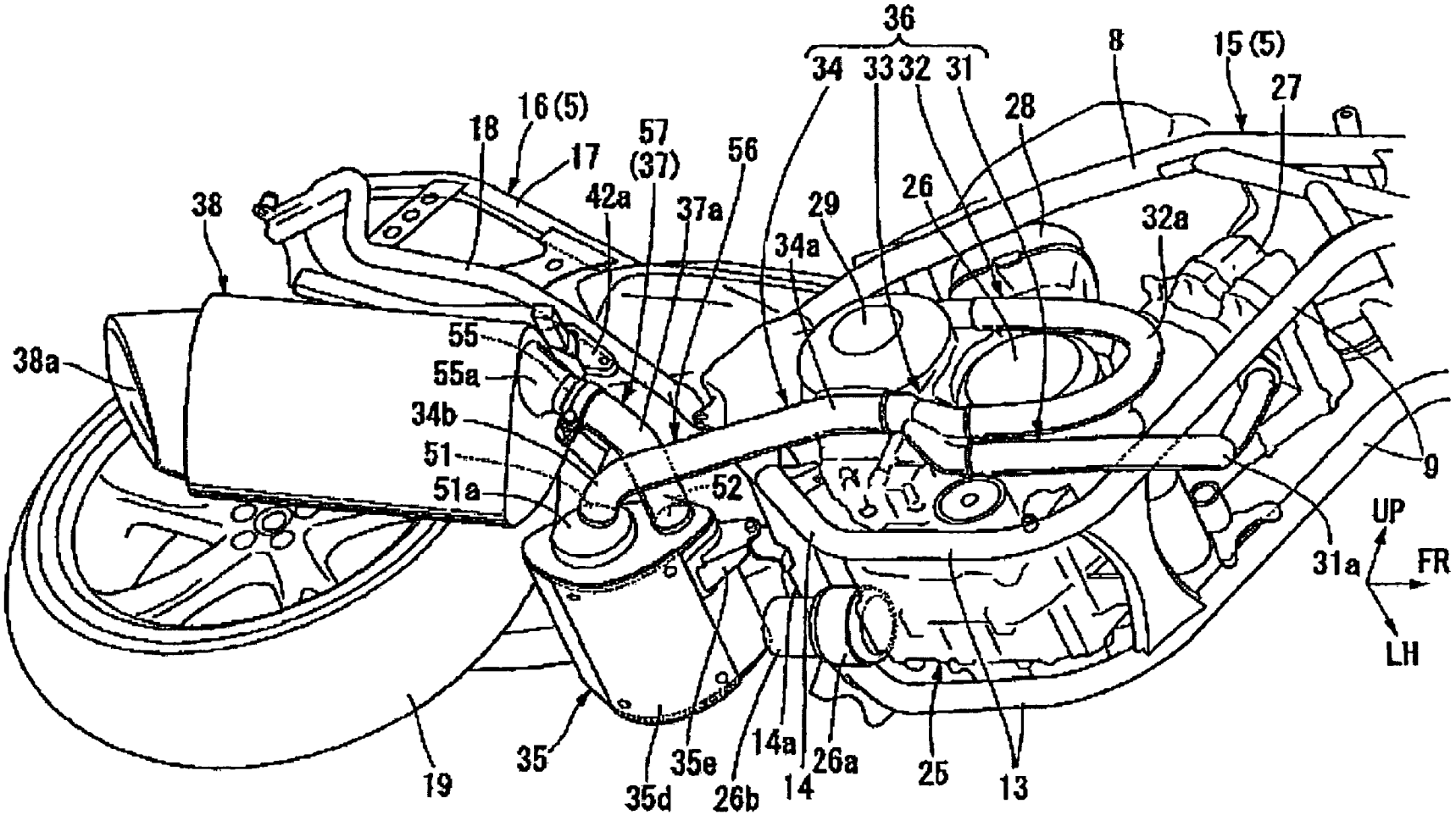
FIG. 5 is a perspective view of the area around the exhaust pipe of the motorcycle, which is viewed from a position ahead of the area on the right, and from below.

As illustrated in FIGS. 2, 4 and 5, the first exhaust pipe 31 bends and extends downwardly at a position immediately in front of the exhaust port 27*b*, and then bends and extends obliquely downwardly to the right-hand side passing between the right and the left down frames 9. The first exhaust pipe 31, then, curves to the rear as running round the right down frame 9 at the lower portion from its front to its right-hand side. After that, the first exhaust pipe 31 extends rearwardly as being substantially parallel to the front-to-rear direction of the vehicle at a position obliquely upwardly to the right-hand side from the right lower frame 13. Hereafter, in the first exhaust pipe 31, the section that curves as running round the right down frame 9 is named a first curve section 31*a*.

On the other hand, the second exhaust pipe 32 curves to the right at a position immediately at the rear of the exhaust port 28*b*. Then, the second exhaust pipe 32 extends forward passing by the right side of the two cylinders 27 and 28. Moreover, the second exhaust pipe 32, at a position located at the right side of the front-end portion of the crankcase 26, curves downwardly and rearwardly so as not to project forward beyond the down frame 9. After that, the second exhaust pipe 32 extends rearwardly as being substantially parallel to the first exhaust pipe 31 at a position obliquely upward to the right. Hereafter, in the second exhaust pipe 32, the section that curves at the right of the crankcase 26 is named a second curve section 32*a*.

The head end portions of the exhaust pipes 31 and 32 join together at the right of the lower portion of the crankcase 26. To this end, for example, the head end portion of the first exhaust pipe 31 bend to be connected to the head end portion of the second exhaust pipe 32. The head end portions of the two exhaust pipes 31 and 32 form the joint portion 33, and, from the single rear end portion of the joint portion 33, the joint exhaust pipe 34 extends slightly downwardly and the rearwardly and slightly diagonally inwardly in the lateral direction of the vehicle body.

To be more specific, the joint exhaust pipe 34 extends rearwardly from the rear end portion of the joint portion 33 as being in parallel to the front-to-rear direction. Then, the joint exhaust pipe 34 bends slightly downwardly to the left, inward in the lateral direction of the vehicle body, at a position immediately at the rear of the joint portion 33, and extends linearly. The joint exhaust pipe 34 then passes by immediately right side of the right lower end frame 14, with the middle section of the joint exhaust pipe 34 in the front-to-rear direction crossing the right lower end frame 14 when viewed from a side. After that, the joint exhaust pipe 34 bends further inwardly in the lateral direction of the vehicle body at a point at the right of the exhaust chamber 35 to be obliquely connected to the right end portion of the exhaust chamber 35. Hereafter, in the joint exhaust pipe 34, the section bending at a position immediately at the rear of the joint portion 33 is named a front-side bending portion 34*a*, while the section bending at a position at the right of the exhaust chamber 35 is named a rear-side bending portion 34*b*. As described above, the joint exhaust pipe 34 bends at a plurality of positions (specifically, at two positions), and is connected obliquely to the exhaust chamber 35. As a result, the bending of the joint exhaust pipe 34 is made moderate to lessen the resistance to the exhaust-gas flow.

Figure 3:
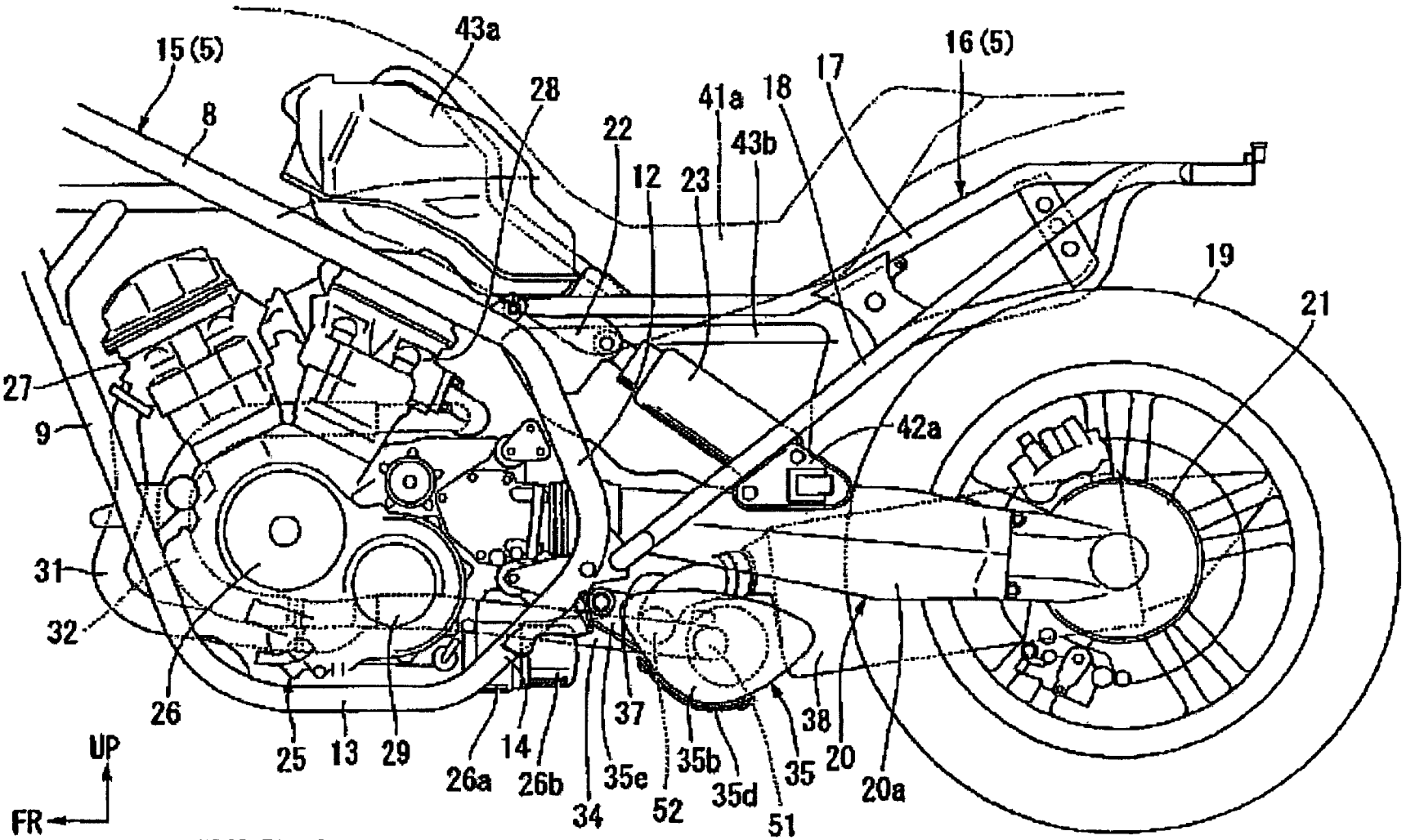
FIG. 3 is a left-side view corresponding to FIG. 2.

As illustrated in FIG. 3, the exhaust chamber 35 extends as being substantially parallel to the lateral direction with the cross-sectional shape being substantially constant. A cylindrical body 35*a*, a left lid member 35*b* and a right lid member 35*c*, each of which closes each one of the two sides of the cylindrical body 35*a* extending along the lateral direction, constitute the exhaust chamber 35. Hereafter, the axial line along the direction in which the exhaust chamber 35 extends is expressed as C1. The exhaust chamber 35 has a cross-sectional shape (also the side-view shape) of a substantial isosceles triangle that is placed upside down. Each of the upper face, the front lower face, and the rear lower face, constitutes each side of the triangle, and each face is a gently-curved outward-convex surface. Each of the parts corresponding to the apexes of the triangle is chamfered in a circular-arc shape which is convex outwardly.

The exhaust chamber is formed in a flattened shape with its vertical width being made smaller than the horizontal width. The exhaust chamber 35 slightly slants downwardly to the rear, so that the upper face of the exhaust chamber 35 also slightly slants downwardly to the rear. The front portion of the swing arm 20, which also slightly slants downwardly to the rear, is positioned over the exhaust chamber 35. Since the upper face of the exhaust chamber 35 slants as being substantially parallel to the swing arm 20, the space needed for the up-and-down movements of the swing arm 20 can be easily secured.

In the exhaust chamber 35, the apex at the bottom in the cross-sectional shape, which apex forms the lower end portion of the exhaust chamber 35, is chamfered in a circular-arc shape that is gentler than the shapes of other apexes. The exhaust chamber 35 faces the ground between the front and the rear wheel of the vehicle body. By chamfering the lower end portion of the exhaust chamber 35, the ground clearance corresponding to this section can be easily secured. It should be noted that a metal plate 35*d* is fixed by fixation means such as rivets to an area around the bottom end portion of the exhaust chamber 35.

A supporting stay 35*e* is provided in the front-end portion of the exhaust chamber 35 as sticking forward out at the middle in the lateral direction. With this supporting stay 35*e*, the front portion of the exhaust chamber 35 is supported by a lower cross member 14*a* that bridges the right and the left lower end frames 14 in the body frame 5.

A water-cooling type oil cooler 26*a* has a cylindrical-shape and extends along the front-to-rear direction and is provided to the lower rear end portion of the crankcase 26 (transmission case 29). To the rear end of the oil cooler 26*a*, a cartridge-type oil filter 26*b* with a cylindrical shape that is substantially coaxial with the oil cooler 26*a* is detachably attached. The oil filter 26*b* is positioned in front of the exhaust chamber 35, but a space is secured in between to use when the oil filter 26*b* is attached or detached.

The exhaust chamber 35 is placed as being slightly shifted to the left of the vehicle body. More specifically, the left-hand end portion of the exhaust chamber 35 is positioned substantially in line with the left lower frame 13 in the lateral direction, while the right-hand end portion of the exhaust chamber 35 is located at an inner position in the lateral direction of the vehicle body than the right lower frame 13.

An exhaust-gas inlet 51 and an exhaust-gas outlet 52 are formed in the right-hand end portion (right-hand lid member 35*c*) of the exhaust chamber 35. The joint exhaust pipe 34 is connected to the exhaust-gas inlet 51, while the downstream-side exhaust pipe 37 leads out from the exhaust-gas outlet 52. In other words, the exhaust-gas inlet 51 and the exhaust-gas outlet 52 are located at inner positions in the lateral direction of the vehicle body than the right lower frame 13.

FIGS. 2, 4 and 5 shows that the exhaust-gas inlet 51 is positioned substantially at the center of the exhaust chamber 35 in the front-to-rear direction. More specifically, a protruding portion 51*a* is formed substantially at the center in the front-to-rear direction in the right-hand end portion. The protruding portion 51*a* projects from the right-hand lid member 35*c* toward the right in a tapered shape like a funnel. At the tip end portion of the protruding portion 51*a*, the exhaust-gas inlet 51 is formed so as to have an opening directed obliquely right to the front. To the exhaust-gas inlet 51, the downstream-side end portion of the joint exhaust pipe 34 is connected from a position located ahead of the exhaust-gas inlet 51 on the right obliquely with respect to the axial line of the chamber C1.

On the other hand, the exhaust-gas outlet 52 is positioned in an upper front portion of the exhaust chamber 35 in a position anterior to and superior to the exhaust-gas inlet 51.

Here, the exhaust chamber 35 is positioned at the rear of the engine 25 when viewed from a side of the vehicle body. The muffler 38 is positioned at the rear of the exhaust chamber 35 with the exhaust port 38*a* at the rear end portion thereof. The upstream-side exhaust pipe 36 is positioned between the engine 25 and the exhaust chamber 35, while the downstream-side exhaust pipe 37 is positioned between the exhaust chamber 35 and the muffler 38 (exhaust port 38*a*). The exhaust gas produced in the engine 25 passes through the upstream-side exhaust pipe 36, the exhaust chamber 35, and the downstream-side exhaust pipe 37 to reach the muffler 38, and then is discharged to the air from the exhaust port 38*a*.

The exhaust-gas outlet 52 is positioned in a side closer to the engine 25 (in the front side) of the exhaust chamber 35, that is, in a side farther from the exhaust port 38*a*. Meanwhile, the exhaust-gas inlet 51 is positioned in a side closer to the exhaust port 38*a* (in the rear side) than the exhaust-gas outlet 52 is, that is, in a side farther from the engine 25 than the exhaust-gas outlet 52 is positioned. With this configuration, the exhaust pipes 36 and 37 are made longer in comparison to a case with a configuration wherein the exhaust-gas inlet 51 is positioned in the front side with the exhaust-gas outlet 52 being positioned in the rear side.

To the exhaust-gas outlet 52, the upstream-side end portion of the downstream-side exhaust pipe 37 is connected from a position behind the exhaust-gas outlet 52 on the right obliquely with respect to the axial line of the chamber C1.

The downstream-side exhaust pipe 37 extends out from the exhaust-gas outlet 52 slightly obliquely, and then bends and extends further rearwardly at a position immediately above the joint exhaust pipe 34. In other words, at a position where the downstream-side exhaust pipe 37 crosses the joint exhaust pipe 34 when viewed from the bottom of the vehicle body. Eventually, the downstream-side end portion of the downstream-side exhaust pipe 37 is connected to the front-end portion of the muffler 38. In other words, the downstream-side exhaust pipe 37, as a whole, extends from the exhaust-gas outlet 52 obliquely rearwardly to the right, that is, to a side away from the exhaust ports 27*b* and 28*b* of the engine 25. Thereafter, in the downstream-side exhaust pipe 37, the section that bends at the position above the joint exhaust pipe 34 is named a downstream-side bending section 37*a*. The downstream-side bending section 37*a* substantially lies over the rear-side bending portion 34*b* of the joint exhaust pipe 34 when viewed from the bottom of the vehicle body.

The exhaust chamber 35 is divided, by a partition wall 53 that is substantially orthogonal to the exhaust chamber in the lateral direction, into a left and a right expansion chambers 53*a* and 53*b*. First, second, and third communication pipes 54*a*, 54*b* and 54*c* are provided inside the exhaust chamber 35. The first communication pipe 54*a* extends from the exhaust-gas inlet 51 to the left, and penetrates the partition wall 53 to allow communication between the exhaust-gas inlet 51 and the left-hand expansion chamber 53*a*. The second communication pipe 54*b* penetrates the partition wall 53 at a position anterior to the position where the first communication pipe 54*a* penetrates the partition wall 53. The second communication pipe 54*b* thus allows the communication between the left and the right expansion chambers 53*a* and 53*b*. The third communication pipe 54*c* extends from the exhaust-gas outlet 52 to the right and allows communication between the right expansion chamber 53*b* and the exhaust-gas outlet 52. Each of the communication pipes 54*a*, 54*b*, and 54*c* are arranged substantially in parallel to the direction of the axial line of the chamber C1 (lateral direction). A catalyst 54*d* for exhaust-gas purification is provided inside each of the first and the third communication pipes 54*a* and 54*c*.

Figure 6:
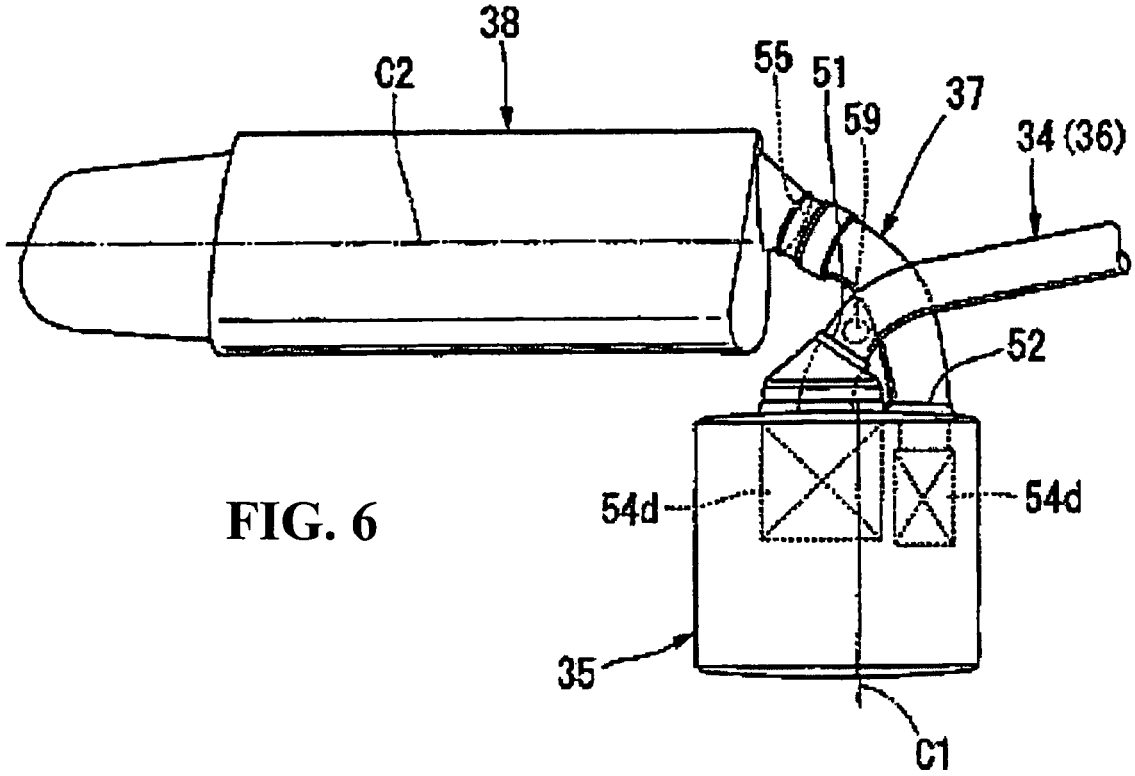
FIG. 6 is a bottom view showing a modified example of an exhaust chamber of the motorcycle.
Figure 7:
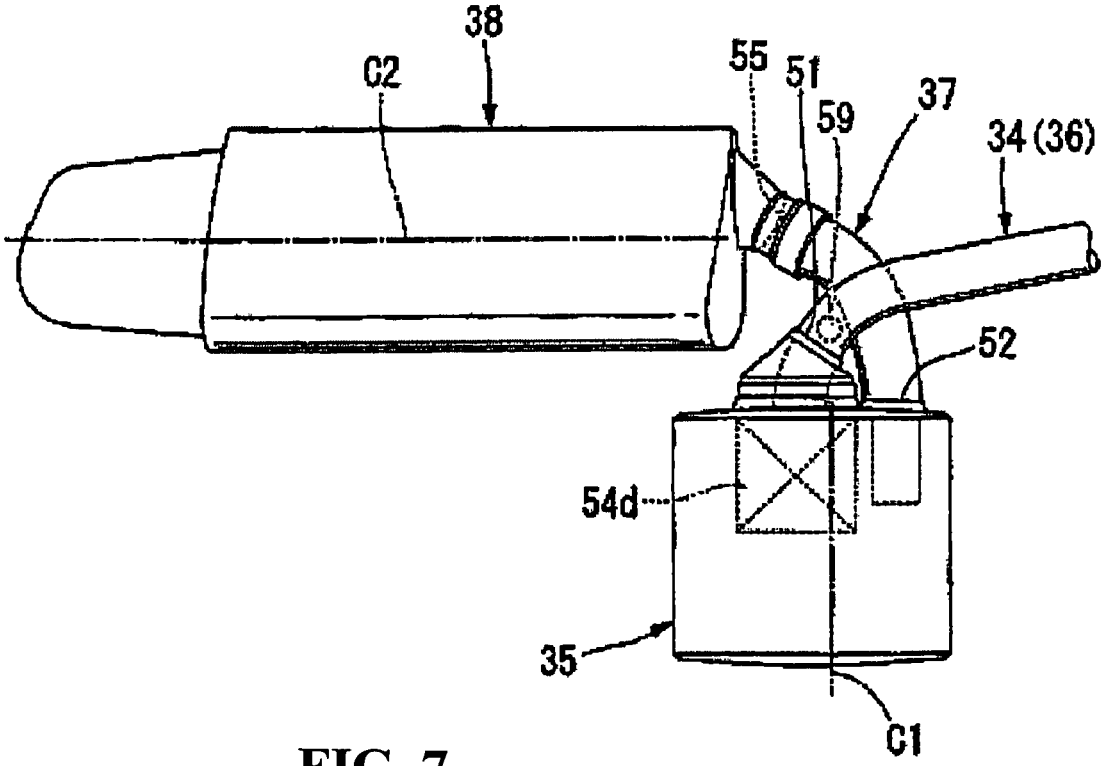
FIG. 7 is a bottom view showing another modified example of the exhaust chamber of the motorcycle.

It should be noted that the exhaust chamber 35 may be formed without the partition wall 53 as shown in FIGS. 6 and 7. In the exhaust chamber 35 shown in FIG. 6, the catalyst 54*d* is provided as being continuous to the joint exhaust pipe 34 (upstream-side exhaust pipe 36). The flow of the exhaust gas purified by the catalyst 54*d* is reversed, and the exhaust gas is introduced into the downstream-side exhaust pipe 37. On the other hand, in the exhaust chamber 35 shown in FIG. 7, the flow of the exhaust gas purified by the catalyst 54*d* is reversed. The exhaust gas is purified by a second catalyst 54*d* that is placed at the entrance of the downstream-side exhaust pipe 37, and then the exhaust gas is introduced into the downstream-side exhaust pipe 37.

The muffler 38 extends in the front-to-rear direction slightly upwardly and rearwardly while the cross-sectional shapes are substantially constant. The muffler 38 is placed as substantially lying over the rear portion of the swing arm 20 when viewed from a side of the vehicle body. Hereafter, the axial line along the extending direction of the muffler 38 is represented by C2. Each of the cross-sectional shapes of the muffler 38 is a triangular shape. The sides of the triangular are composed of an upper face that extends substantially along the lateral direction, an inner side face that extends substantially along the vertical direction, and a slant face that extends from the right-hand end of the upper face to the bottom end of the inner side face. With this shape, a larger bank angle is secured on the right-hand side of the vehicle body. The middle portion in the front-to-rear direction of the muffler 38 is supported by a right-hand pillion step holder 42*a*, which serves as a muffler stay.

In the upper right side of the front-end portion of the muffler 38, a protruding portion 55*a* is formed in a funnel shape that projects and is tapered forward from the front-end portion. At the tip end portion of the protruding portion 55*a*, an exhaust-gas inlet 55 is formed as an opening directed obliquely toward the left to the front. To the exhaust-gas inlet 55, the downstream-side end portion of the downstream-side exhaust pipe 37 is connected from a position ahead of the exhaust-gas inlet 55 on the left obliquely with respect to the axial line of the muffler C2.

As described above, the exhaust-gas inlet 55 of the muffler 38 is positioned on the right side, on the outer side in the lateral direction of the vehicle body. Accordingly, the exhaust-gas inlet 55 is positioned away from the exhaust-gas outlet 52 of the exhaust chamber 35 which is positioned at the left side of, at the inner side in the lateral direction of the vehicle body than, the muffler 38. As a result, the downstream-side exhaust pipe 37 is elongated with compare to a case in which the exhaust-gas inlet 55 is positioned on the left side.

As described before, the joint exhaust pipe 34 is obliquely connected to the exhaust chamber 35. Accordingly, a space where some component parts can be placed is produced at the right side of the rear portion of the exhaust chamber 35. By utilizing the space, the front-end portion of the muffler 38 extends so as to overlap the rear portion of the exhaust chamber 35 when viewed from a side of the vehicle body. As a result, the volume of the muffler 38 as a whole is increased to improve the sound deadening performance.

In addition, the middle section of the upstream-side exhaust pipe 36, the section of each of the first and the second exhaust pipes 31 and 32, respectively further downstream from the curve portions 31*a* and 31*b* to the middle section in the front-to-rear direction of the joint exhaust pipe 34, is formed as winding to the outer side of the vehicle body in the lateral direction than the body frame 5, the right down frame 9, the right lower frame 13, the right lower end frame 14. Since the upstream-side exhaust pipe 36 curves as being convex outward in the lateral direction of the vehicle body, the upstream-side exhaust pipe 36 can be elongated.

A section of the joint exhaust pipe 34 on the further downstream side than the front-side bending portion 34*a* is an inward diagonal section 56 in which the pipe goes inward in the lateral direction of the vehicle body as the pipe goes down the stream (rearwardly) of the exhaust gas. On the other hand, the downstream-side exhaust pipe 37 in this embodiment, as a whole, is an outward diagonal section 57 in which the pipe goes outwardly in the lateral direction of the vehicle body as the pipe goes down the stream (rearwardly) of the exhaust gas. These diagonal sections 56 and 57 are placed as crossing each other when viewed from the bottom of the vehicle body at a position substantially below the seat position of the front seat 41*a* when viewed from a side of the vehicle body. The widths of parts of the respective diagonal sections 56 and 57, which parts are located outside the vehicle body in the lateral direction, are made minimum at a crossing portion 58 where the diagonal sections cross each other when viewed from the bottom of the vehicle body. With this structure, a larger space on which the rider places his/her foot when the rider is seated on the front seat 41*a* or when the rider climbs on the motorcycle, can be secured directly below the front seat 41*a* and near the vehicle body.

Inside the joint exhaust pipe 34, an oxygen-concentration sensor ($O_2$ sensor) 59 is provided between the rear-side bending portion 34*b* and the exhaust-gas inlet 51 to detect the oxygen concentration of the exhaust gas. The oxygen-concentration sensor 59 is placed with its detection unit facing the inside of the joint exhaust pipe 34 from above. The upwardly protruding portion of the oxygen-concentration sensor 59 from the joint exhaust pipe 34 is surrounded by the downstream-side exhaust pipe 37 from the front side and the right side of the protruding portion. The exhaust chamber 35 is positioned at the left side of the protruding portion, while the muffler 38 is positioned at the rear side of the protruding portion. With this structure, the oxygen-concentration sensor 59 is better protected, and becomes more easily heated to reach swiftly the activation temperature.

As has been described thus far, the exhaust pipe structure in the above-described embodiment includes the engine 25 supported by the body frame 5 and the upstream-side exhaust pipe 36 connected to the exhaust ports 27*b* and 28*b* of the engine 25. Also included in the exhaust pipe structure is the exhaust chamber 35 which has the exhaust-gas inlet 51 and the exhaust-gas outlet 52, and in which the upstream-side exhaust pipe 36 is connected to the exhaust-gas inlet 51. The exhaust pipe structure additionally includes the downstream-side exhaust pipe 37 which is connected to the exhaust-gas outlet 52, and which extends in a direction to move away from the exhaust ports 27*b* and 28*b*. The exhaust-gas inlet 51 is formed at a position farther away from the exhaust ports 27*b* and 28*b* than the exhaust-gas outlet 52 is positioned.

According to this configuration, the lengths of the upstream-side and the downstream-side exhaust pipes 36 and 37 can be made longer, in comparison to the case in which the exhaust-gas inlet 51 is placed closer to the exhaust ports 27*b* and 28*b* than the exhaust-gas outlet 52 is positioned. Meanwhile, the length of the exhaust pipe structure as a whole in the front-to-rear direction is restricted. As a result, the adjustment range for engine characteristics can be widened. For example, the kind of engine characteristics in which the change in engine power is made to depend linearly on the throttle-opening angle, can be made easily reproducible. This is particularly preferable in a V-type two-cylinder engine. This is because it is more effective in such an engine to elongate the distance between the joint portion 33 of the two exhaust pipes respectively from the cylinders 27 and 28 and the exhaust chamber 35 located at the downstream side from the joint portion 33, more specifically, the length of the joint exhaust pipe 34.

In addition, in the above-described exhaust pipe structure, the body frame 5 includes the head pipe 6 with the right and left pair of down frames 9 extending obliquely downwardly and rearwardly from the head pipe 6. Each lower frame 13 is provided as extending rearwardly from the bottom end of each down frame 9. Each lower end frame 14 is provided as extending obliquely upwardly and rearwardly from the rear end of each lower frame 13. The exhaust chamber 35 is placed at the rear of the lower end frames 14 when viewed from a side of the vehicle. Accordingly, the space at the rear of the lower end frames 14 extending obliquely upwardly and rearwardly can be effectively utilized as a space where the exhaust chamber 35 is placed. As a result, a sufficient volume of the exhaust chamber 35 can be secured.

Moreover, in the above-described exhaust pipe structure, the exhaust ports 27*b* and 28*b* as well as the exhaust-gas inlet 51 are placed inside the body frame 5 in the lateral direction, while the middle section of the upstream-side exhaust pipe 36 is made to be located outside of the body frame 5 in the lateral direction. Accordingly, the upstream-side exhaust pipe 36 can be made to curve as being convex outwardly of the vehicle body. As a result, the adjustment range for engine characteristics can be widened.

Furthermore, in the above-described exhaust pipe structure, the upstream-side exhaust pipe 36 includes the inward diagonal section 56 in which the pipe goes inward in the lateral direction of the vehicle body as the pipe goes down the stream of the exhaust gas. Meanwhile, the downstream-side exhaust pipe 37 includes the outward diagonal section 57 in which the pipe goes outward in the lateral direction of the vehicle body as the pipe goes down the stream of the exhaust gas. The inward diagonal section 56 and the outward diagonal section 57 cross each other when viewed from the bottom of the vehicle body at a position below the front seat 41*a* supported by the body frame 5. Accordingly, the projection, outside of the vehicle body, of the upstream-side and the downstream-side exhaust pipes 36 and 37 is made small in the crossing portion 58 of the inward diagonal section 56 and the outward diagonal section 57 when viewed from the bottom of the vehicle body. As a result, the rider can plant his/her foot more easily on the ground by widening the space on which the rider can place his/her foot below the front seat 41*a*.

It should be noted that the present invention is not limited to the above-described embodiment. The present invention can be applied, for example, to a single-cylinder engine or to various types of in-line engines. In addition, the present invention can be applied to a three-wheel, or a four-wheel vehicle. Moreover, the present invention can be carried out with the exhaust chamber 35 being the only silencer that the vehicle has. Furthermore, the present invention can have a configuration in which a part of the downstream-side exhaust pipe 37 is made to be the outward diagonal section 57.

The configuration in the above-described embodiment is only an example of the present invention. It is obvious that various changes may be made without departing from the scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust pipe structure comprising:

an engine supported by a body frame, having a front portion and a rear portion;

an upstream-side exhaust pipe connected to an exhaust port of the engine;

an exhaust chamber including a lid member having an exhaust-gas inlet and an exhaust-gas outlet formed in the lid member wherein the upstream-side exhaust pipe is connected to the exhaust-gas inlet; and a downstream-side exhaust pipe connected to the exhaust-gas outlet and extending out to a direction as moving away from the exhaust port;

wherein the exhaust-gas inlet is positioned on the lid towards the rear portion of said frame that is farther away from the exhaust port than the exhaust-gas outlet is positioned on the lid towards a front portion of the front portion of the frame.

2. The exhaust pipe structure according to claim 1, wherein the body frame includes a head pipe and a right and left pair of down frames extending obliquely downwardly and rearwardly from the head pipe;

a lower frame extends rearwardly from a bottom end of the down frame;

a lower end frame extends obliquely upwardly and rearwardly from the rear end of the lower frame; and the exhaust chamber is placed at the rear of the lower end frame from a side view of the vehicle.

3. The exhaust pipe structure according to claim 1, wherein the exhaust port and the exhaust-gas inlet are placed in positions located at an inner side in the lateral direction of the vehicle body; and a middle section of the upstream-side exhaust pipe is placed in a position at an outer side in the lateral direction of the vehicle body.

4. The exhaust pipe structure according to claim 2, wherein the exhaust port and the exhaust-gas inlet are placed in positions located at an inner side in the lateral direction of the vehicle body; and a middle section of the upstream-side exhaust pipe is placed in a position at an outer side in the lateral direction of the vehicle body.

5. The exhaust pipe structure according to claim 1, wherein the upstream-side exhaust pipe includes an inward diagonal section in which the pipe goes inward of the vehicle body as the pipe goes down the stream of the exhaust gas;

the downstream-side exhaust pipe includes an outward diagonal section in which the pipe goes outward of the vehicle body as the pipe goes down the stream of the exhaust gas; and the inward diagonal section and the outward diagonal section cross each other, when viewed from the bottom of the vehicle body, in a position below the rider's seat supported by the vehicle frame.

6. The exhaust pipe structure according to claim 2, wherein the upstream-side exhaust pipe includes an inward diagonal section in which the pipe goes inward of the vehicle body as the pipe goes down the stream of the exhaust gas;

the downstream-side exhaust pipe includes an outward diagonal section in which the pipe goes outward of the vehicle body as the pipe goes down the stream of the exhaust gas; and the inward diagonal section and the outward diagonal section cross each other, when viewed from the bottom of the vehicle body, in a position below the rider's seat supported by the vehicle frame.

7. The exhaust pipe structure according to claim 3, wherein the upstream-side exhaust pipe includes an inward diagonal section in which the pipe goes inward of the vehicle body as the pipe goes down the stream of the exhaust gas;

the downstream-side exhaust pipe includes an outward diagonal section in which the pipe goes outward of the vehicle body as the pipe goes down the stream of the exhaust gas; and the inward diagonal section and the outward diagonal section cross each other, when viewed from the bottom of the vehicle body, in a position below the rider's seat supported by the vehicle frame.

8. An exhaust pipe structure comprising:

an engine supported by a body frame extending from a front portion to a rear portion;

an upstream-side exhaust pipe connected to an exhaust port of the engine;

an exhaust chamber including a lid member having an exhaust-gas inlet and an exhaust-gas outlet formed in the lid member wherein the upstream-side exhaust pipe is connected to the exhaust-gas inlet; and a downstream-side exhaust pipe connected to the exhaust-gas outlet and extending in a direction towards the rear portion of the frame;

wherein the exhaust-gas inlet is positioned on the lid member is closer relative to the rear portion of the body frame as compared to the exhaust-gas outlet on the lid member which is placed at a position that is closer to the front portion of the body frame.

9. The exhaust pipe structure according to claim 8, wherein the body frame includes a head pipe and a right and left pair of down frames extending obliquely downwardly and rearwardly from the head pipe;

a lower frame extends rearwardly from a bottom end of the down frame;

a lower end frame extends obliquely upwardly and rearwardly from the rear end of the lower frame; and the exhaust chamber is placed at the rear of the lower end frame from a side view of the vehicle.

10. The exhaust pipe structure according to claim 8, wherein the exhaust port and the exhaust-gas inlet are placed in positions located at an inner side in the lateral direction of the vehicle body; and a middle section of the upstream-side exhaust pipe is placed in a position at an outer side in the lateral direction of the vehicle body.

11. The exhaust pipe structure according to claim 9, wherein the exhaust port and the exhaust-gas inlet are placed in positions located at an inner side in the lateral direction of the vehicle body; and a middle section of the upstream-side exhaust pipe is placed in a position at an outer side in the lateral direction of the vehicle body.

12. The exhaust pipe structure according to claim 8, wherein the upstream-side exhaust pipe includes an inward diagonal section in which the pipe goes inward of the vehicle body as the pipe goes down the stream of the exhaust gas;

the downstream-side exhaust pipe includes an outward diagonal section in which the pipe goes outward of the vehicle body as the pipe goes down the stream of the exhaust gas; and the inward diagonal section and the outward diagonal section cross each other, when viewed from the bottom of the vehicle body, in a position below the rider's seat supported by the vehicle frame.

13. The exhaust pipe structure according to claim 9, wherein the upstream-side exhaust pipe includes an inward diagonal section in which the pipe goes inward of the vehicle body as the pipe goes down the stream of the exhaust gas;

the downstream-side exhaust pipe includes an outward diagonal section in which the pipe goes outward of the vehicle body as the pipe goes down the stream of the exhaust gas; and the inward diagonal section and the outward diagonal section cross each other, when viewed from the bottom of the vehicle body, in a position below the rider's seat supported by the vehicle frame.

14. The exhaust pipe structure according to claim 10, wherein the upstream-side exhaust pipe includes an inward diagonal section in which the pipe goes inward of the vehicle body as the pipe goes down the stream of the exhaust gas;

the downstream-side exhaust pipe includes an outward diagonal section in which the pipe goes outward of the vehicle body as the pipe goes down the stream of the exhaust gas; and the inward diagonal section and the outward diagonal section cross each other, when viewed from the bottom of the vehicle body, in a position below the rider's seat supported by the vehicle frame.

15. An exhaust pipe structure for use with an engine having an exhaust port comprising:

an upstream-side exhaust pipe adapted to be connected to the exhaust port of the engine;

an exhaust chamber including an exhaust-gas inlet and an exhaust-gas outlet wherein the upstream-side exhaust pipe is connected to the exhaust-gas inlet; and a downstream-side exhaust pipe connected to the exhaust-gas outlet and extending out to a direction as moving away from the exhaust port;

wherein the exhaust-gas inlet is placed at a position that is displaced a predetermined greater distance from the exhaust port of the engine relative to the distance the exhaust-gas outlet is positioned, the exhaust-gas inlet and the exhaust-gas outlet are located on a surface of the exhaust chamber, the surface defines a plane, and the exhaust-gas inlet and the exhaust-gas outlet are substantially on the plane.

16. The exhaust pipe structure for use with an engine according to claim 15, wherein a body frame includes a head pipe and a right and left pair of down frames extending obliquely downwardly and rearwardly from the head pipe;

a lower frame extends rearwardly from the bottom end of the down frame;

a lower end frame extends obliquely upwardly and rearwardly from the rear end of the lower frame; and the exhaust chamber is placed at the rear of the lower end frame from a side view of the vehicle.

17. The exhaust pipe structure for use with an engine according to claim 15, wherein the exhaust port and the exhaust-gas inlet are placed in positions located at an inner side in the lateral direction of the vehicle body; and a middle section of the upstream-side exhaust pipe is placed in a position at an outer side in the lateral direction of the vehicle body.

18. The exhaust pipe structure for use with an engine according to claim 16, wherein the exhaust port and the exhaust-gas inlet are placed in positions located at an inner side in the lateral direction of the vehicle body; and a middle section of the upstream-side exhaust pipe is placed in a position at an outer side in the lateral direction of the vehicle body.

19. The exhaust pipe structure for use with an engine according to claim 1, wherein the upstream-side exhaust pipe includes an inward diagonal section in which the pipe goes inward of the vehicle body as the pipe goes down the stream of the exhaust gas;

the downstream-side exhaust pipe includes an outward diagonal section in which the pipe goes outward of the vehicle body as the pipe goes down the stream of the exhaust gas; and the inward diagonal section and the outward diagonal section cross each other, when viewed from the bottom of the vehicle body, in a position below the rider's seat supported by the vehicle frame.

20. The exhaust pipe structure for use with an engine according to claim 16, wherein the upstream-side exhaust pipe includes an inward diagonal section in which the pipe goes inward of the vehicle body as the pipe goes down the stream of the exhaust gas;

the downstream-side exhaust pipe includes an outward diagonal section in which the pipe goes outward of the vehicle body as the pipe goes down the stream of the exhaust gas; and the inward diagonal section and the outward diagonal section cross each other, when viewed from the bottom of the vehicle body, in a position below the rider's seat supported by the vehicle frame.

* * * * *